United States Patent [19]

Cramer et al.

[11] Patent Number: 4,581,182

[45] Date of Patent: Apr. 8, 1986

[54] SUBMERSIBLE MIXER WITH AIR INJECTION

[75] Inventors: Barry G. Cramer; Roy A. Cramer, both of Kansas City, Mo.

[73] Assignee: Air-O-Lator Corporation, Kansas City, Mo.

[21] Appl. No.: 704,063

[22] Filed: Feb. 21, 1985

[51] Int. Cl.[4] ..... B01F 3/04

[52] U.S. Cl. ..... 261/93; 210/220; 210/221.2; 210/241; 261/DIG. 47; 366/101; 366/261

[58] Field of Search ..... 261/93, 120, DIG. 47, 261/DIG. 75; 209/169, 170; 210/220, 241, 221.2, 170; 366/101, 261

[56] References Cited

U.S. PATENT DOCUMENTS

| | | | |
|---|---|---|---|
| 1,398,394 | 11/1921 | Robbins | 209/170 X |
| 3,365,178 | 1/1968 | Bood | 261/DIG. 75 |
| 3,837,629 | 9/1974 | Matras et al. | 261/DIG. 47 |
| 4,043,909 | 8/1977 | Endo et al. | 210/170 X |
| 4,112,025 | 9/1978 | Wilson et al. | 261/DIG. 75 |
| 4,210,613 | 7/1980 | Webb | 261/120 |
| 4,268,398 | 5/1981 | Shuck et al. | 210/221.2 X |
| 4,273,732 | 6/1981 | Roediger | 261/DIG. 47 |
| 4,409,100 | 10/1983 | Bajendren | 261/93 X |
| 4,431,597 | 2/1984 | Cramer et al. | 261/93 |
| 4,443,335 | 4/1984 | Gullace | 210/220 |
| 4,464,259 | 8/1984 | Cramer et al. | 210/220 X |

FOREIGN PATENT DOCUMENTS

| | | | |
|---|---|---|---|
| 56-14336 | 4/1981 | Japan | 261/DIG. 47 |

OTHER PUBLICATIONS

Flygt 450 Submersible Mixer brochure (1979).

*Primary Examiner*—Richard L. Chiesa
*Attorney, Agent, or Firm*—Litman, Day and McMahon

[57] ABSTRACT

A submersible mixer apparatus for circulating liquid in a body of water, such as a sewage lagoon, includes an upright beam member closed to form an air reservoir chamber and upper and lower supports holding the beam member in the body of liquid. A submersible motor and propeller are connected to the beam member by a bracket movable up and down on the beam member and a square tubular support arm affixed to the bracket and to which the submersible motor and propeller are mounted. The support arm is hollow and pressurized air is routed through the upright beam member and the support arm to an outlet of the support arm positioned substantially at the propeller to inject air into the flow area created by the propeller. A selectively engageable and disengageable connector arrangement is positioned between the upright beam member and the support arm which, when engaged, routes the air from the upright beam member into the support arm.

5 Claims, 5 Drawing Figures

SUBMERSIBLE MIXER WITH AIR INJECTION

FIELD OF THE INVENTION

This invention relates to mixing devices in general and particularly to a mixing aerator which can be positioned within a body of liquid to direct a mixing flow of liquid and air bubbles.

BACKGROUND OF THE INVENTION

In the mixing of large bodies of liquid, several different types of mixers have been used, such as water floats and pumps. Generally, the flotation type does not sufficiently mix the water in a large sewage lagoon to provide aerated flow throughout the entire impoundment. Certain mixers are commonly used in aerating lagoons in which active biological solids are in equilibrium with an applied waste. The basin is of sufficient depth, normally six to twelve feet and oxygen is furnished by mechanical aeration to create a turbulence level sufficient to provide adequate liquid mixing. As a result of the mixing, uniform distribution of the waste and dispersion of the oxygen is achieved and rapid and efficient waste biodegradation occurs.

Some aerators, such as our horizontal mixing aerator disclosed in U.S. Pat. No. 4,431,597 are sufficiently controllable in various directions of flow for maximum efficiency. Our previous aerator injected pressurized air into the body of liquid by providing an air flow line or conduit in the form of a flexible hose, which was draped over the sidewall of the sewage lagoon, extended down into the body of liquid and connected to an air injection nozzle affixed to one of the support brackets holding a submersible motor and propeller arrangement. This hose was excessively heavy to lift, even by a winch, and foreign matter tended to collect on the rough surface of the hose so that it was an extremely filthy job to retrieve the hose when the mixer was lifted for inspection. Moreover, the material of the hose, such as neoprene rubber after a period of time became subject to attack by bacterial organisms and became sticky, slimy and increasingly subject to cuts and leaks.

OBJECTS OF THE INVENTION

The principal objects of the present invention are: to provide a liquid circulating apparatus or aerator which uses no hoses for exposure to the detrimental effects of use in a sewage lagoon; to provide such an aerator which does not use hoses which become excessively heavy when lifting the mixing device and become draped and encrusted with sewage material; to provide such an aerator having internal air routing or passage means; to provide such an aerator in which support and structural members provide dual functions of providing structure and providing internal passages for air injection; to provide such a mixing aerator which includes air injection for increased mixing of oxygen within a body of liquid; and to provide such a mixing aerator which is sturdy and efficient in use and particularly well adapted for its intended purpose.

Other objects and advantages of this invention will become apparent from the following description taken in conjunction with the accompanying drawings wherein are set forth, by way of illustration and example, certain embodiments of this invention.

DESCRIPTION OF THE PREFERRED AND ALTERNATE EMBODIMENTS

Figure 2:
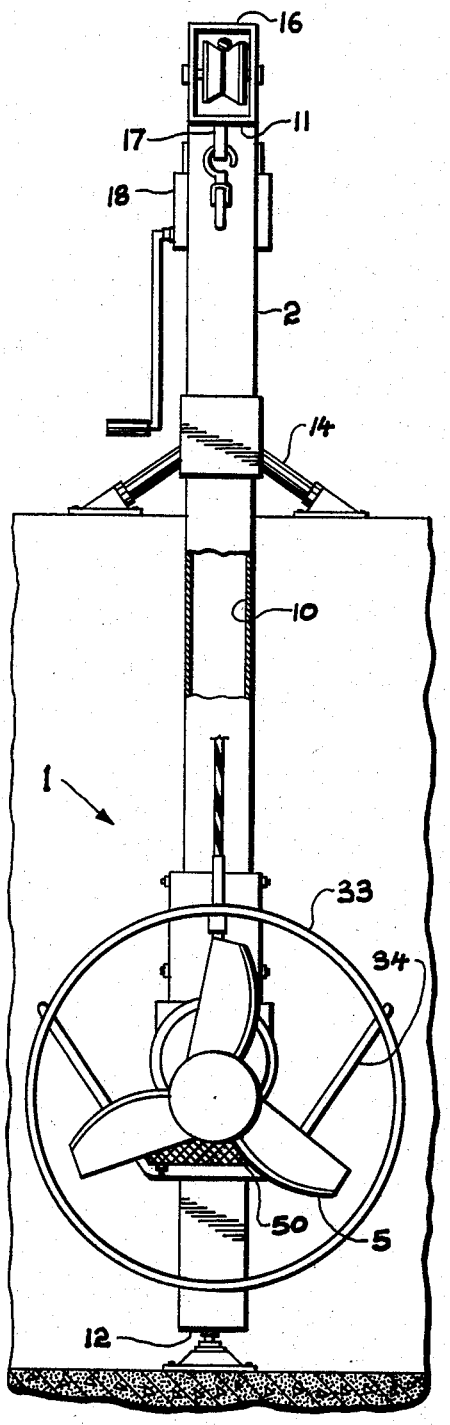
FIG. 2 is a front elevational view of the mixing aerator.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates a mixing aerator embodying the present invention. In overview, the aerator 1 includes an upright beam member or post supported at its top and bottom ends and which extends into a body of liquid within an equilization basin, oxidation ditch or sludge holding tank. A power unit 3 includes a submersible motor 4 driving a propulsion means such as a propeller 5 to create a mixing flow or current within the body of liquid. The motor 4 and propeller 5 are mounted upon a support arm 6 connected to the beam member 2 by a bracket 7. Air is routed through the beam member 2 and the support arm 6 via a connection means 8.

In the illustrated example, the upright beam member 2 is of a box beam construction and has a hollow interior forming a chamber 10 and closed top and bottom ends 11 and 12 closing the chamber 10. The bottom end 11 of the beam member 2 is rotatably supported in the basin by a pivot such as a ball joint 13 and an upper end of the beam member 2 is supported relative to the equilization basin, sludge holding tank, etc. by an appropriate brace arrangement 14.

Figure 1:
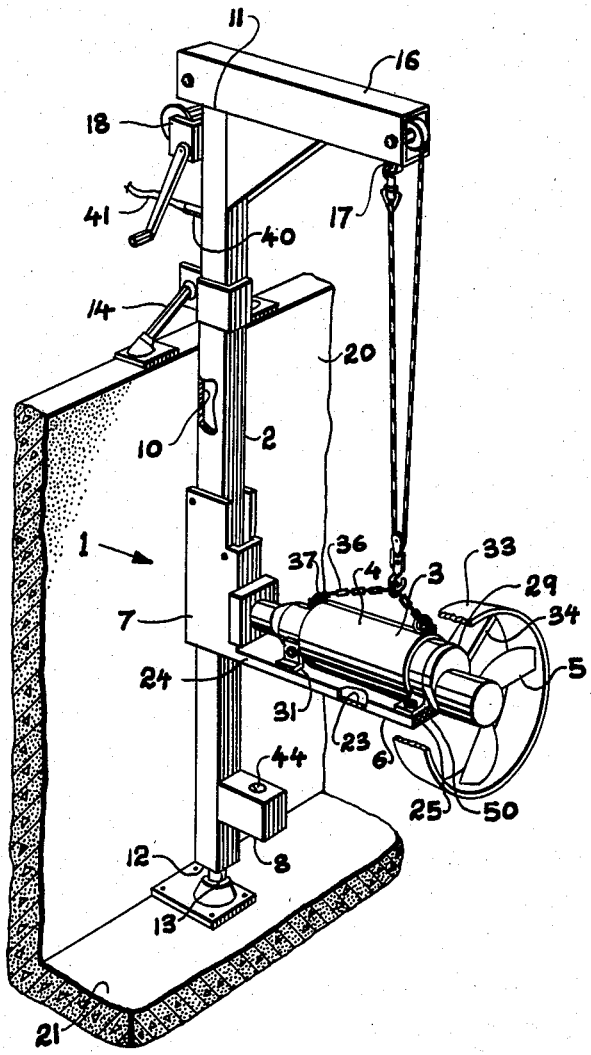
FIG. 1 is a perspective view of a liquid circulating aerator embodying the present invention and is shown in connection with a portion of a tank wall.

A beam forming a lift boom 16 is affixed to the top end 11 of the beam member 2 and extends outwardly, terminating at a pulley end 17. A winch and cable arrangement 18 is routed through the boom 16, extends downwardly from the pulley end 17 and connects to the motor 4, FIG. 1, for raising and lowering the bracket, support arm 6 and the power unit 3 for inspection, repair and general maintenance.

In the illustrated example, the aerator 1 is mounted adjacent a sidewall 20 of a suitable basin, pond, ditch or the like and rests upon the basin bottom 21, although it can be mounted from a catwalk or bridge extending across the basin.

The bracket 7, movably engaged with the beam member 2, is of a transverse dimension greater than the beam member 2 and includes a plurality of means facilitating sliding action, such as guide pins. The bracket 7 is also generally of a rectangular configuration. Affixed, as by welding, to the bracket 7 is a support arm 6. In the illustrated example, the support arm 6 is an elongate beam member of thin, rectangular configuration with a hollow interior forming a passage 23 throughout the length of the support arm 6. The support arm 6 has an inlet end 24 affixed to the bracket 7 and extending outwardly thereof and an outlet end 25 generally positioned adjacent the propeller 5.

The power unit 3 includes the motor 4 which is connected through a reduction gear box 29 to a propulsion means such as the propeller 5. The motor 4 and reduction gear box 29 are mounted atop the support arm 6 by mounting brackets 31. A shroud 33 in the form of a cylindrical solid metal or expanded metal cage extends over the area of the propeller 5 and is supported by spaced mounting arms 34 extending from the shroud 33 and to the support arm 6. To control the height of the bracket 7 and support arm 6 with the power unit 3 mounted thereon, the winch and cable arrangement 18 is connected to a chain 36 affixed to spaced lift eyes 37 on the motor 4.

As described above, the aerator 1 preferably has no hoses or the like which extend down into the sewage lagoon and which can become encrusted with sewage material, which makes the hose heavier to lift and subjects the hose to biodegradation. Pressurized air is supplied to the aerator without routing through long hoses and the like which extend into the sewage liquid. A fitting 40 such as of the quick release type is affixed to the beam member 2 and adjacent the top end 11, and a hose 41, from a source of pressurized air such as a compressor, is connected to the fitting 40. Pressurized air coursing through the hose 41 and the fitting 40 flows through the chamber 10 formed by the beam member 22, to the support arm 6 and out its outlet end 25 through the connection means 8.

Figure 3:
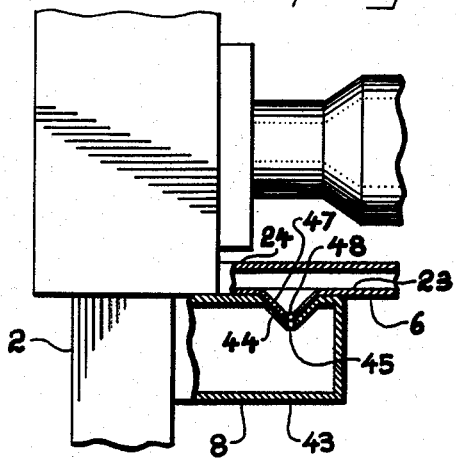
FIG. 3 is an enlarged fragmentary side view of the aerator and showing connection members mutually engaged.
Figure 4:
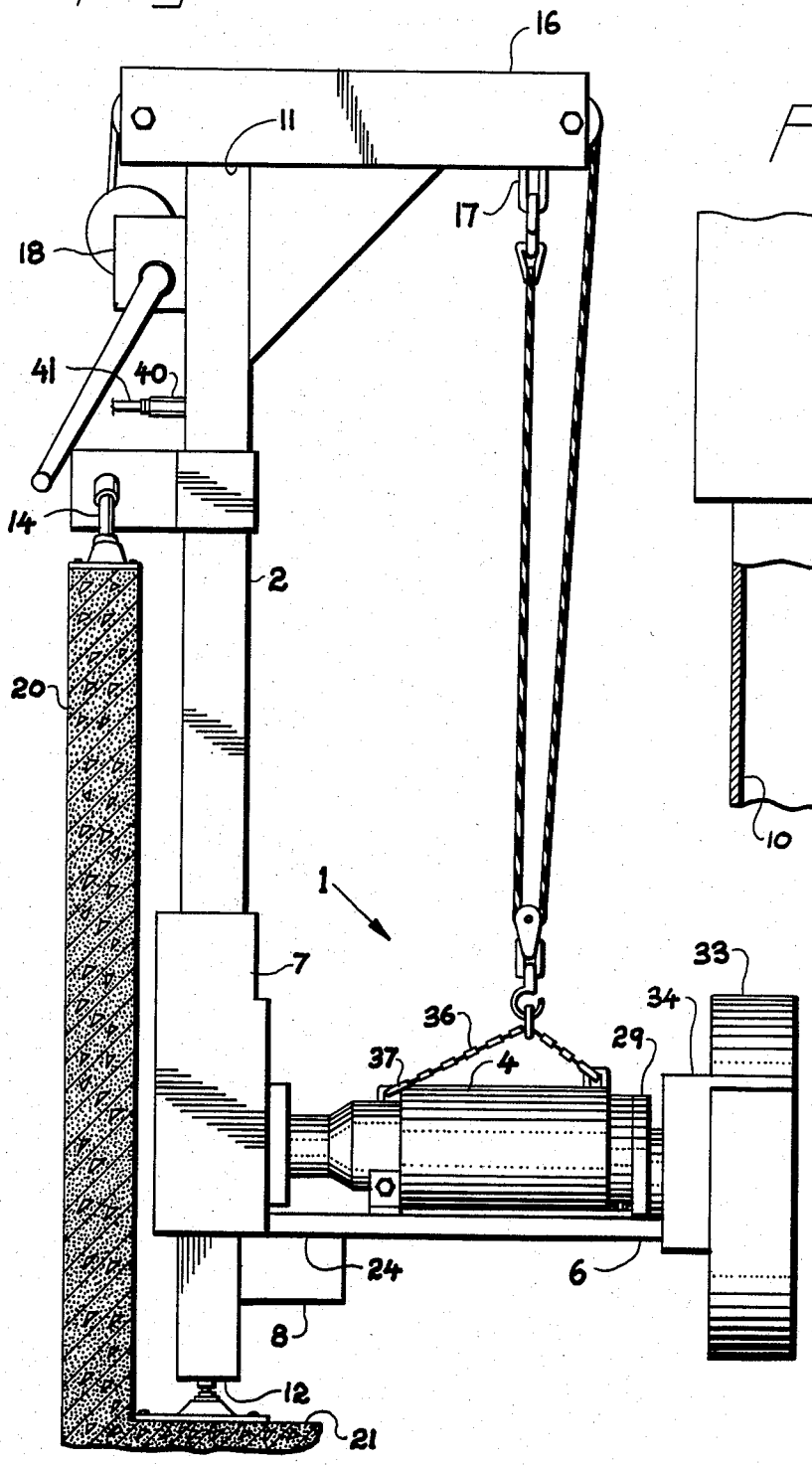
FIG. 4 is a side elevational view of the aerator.
Figure 5:
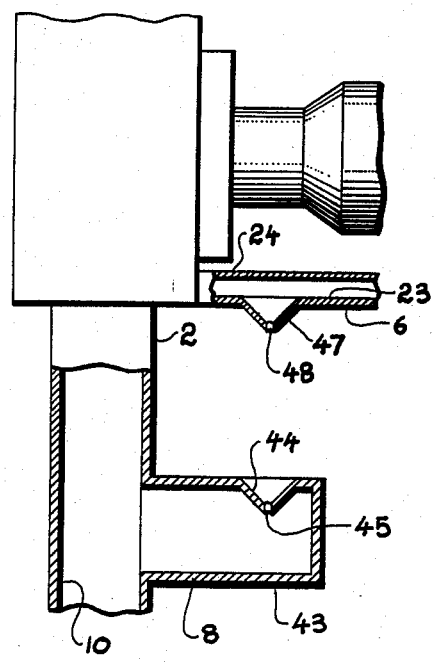
FIG. 5 is a fragmentary elevational side view of the aerator showing the connecting members disengaged.

In the illustrated example, the connection means 8 includes mating cones which are selectively interconnectable and when, when connected, are relatively leak-free. In the illustrated example, the mating cone arrangement includes a stub arm 43 affixed to and extending outwardly of the beam member 2 a short distance upwardly from the bottom end 12 and having a conical inlet 44 having a through bore 45 at the cone apex. The stub arm 43 also serves as a stop against further downward movement of the bracket 7, support arm 6 and power unit 3. On the underside of the support arm 6 at the inlet end 24 is positioned a coordinating conical extension 47 with through bore 48 at the cone apex. Preferably, the conical inlet 44 and conical extension 47 are composed of a material having a surface texture to promote sealing therebetween when engaged, FIG. 3. The material can be a synthetic thermoplastic material, synthetic rubber or even metal with roughened surfaces for airtight interengagement. As shown in FIG. 5, upon raising the bracket 7, support arm 6 and power unit 3 by the winch and cable arrangement 18, the connection means 8 become separated, i.e. the conical extension 47 is pulled upwardly and away from the conical inlet 44 in a disengaged relationship. Accordingly, the bracket 7, support arm 6 and power unit 3 can then be retrieved from the body of liquid for inspection, maintenance and repair.

Connection of the conical extension 47 with the conical inlet 44 is again made when the winch and cable arrangement is used to let the bracket 7, support arm 6 and power unit 3 downwardly on the beam member 2 until encountering the stub arm 43, which serves as a stop to further downward movement and removes the weight of the overlying structures from depending upon the winch and cable arrangement 18. The conical extension 47 slides into the conical inlet 44 as the assembly is let downwardly and provides centering. Upon bottoming out against the stub arm 43, the conical extension 47 and conical inlet 44 automatically align the bores 45 and 48 to provide an airflow path from the hose 41 through the fitting 40, through the chamber 10 in the beam member 2 through the stub arm 43 and the bore 45, the bore 48, through the passage 23 of the support arm 6 and out the outlet end 25.

Depending on the preference of the user, flow of compressed air may be turned off during the disconnection, reconnection procedures or may be left on as desired. If the user desires to shut off the flow of pressurized air, a valve can be provided in the hose 41 or the hose 41 can be disconnected at the quick disconnect fitting 40.

Finally, the air courses out through the outlet end 25 into the turbulent flow created by the propeller 5. To ensure that the air emitted is in the form of flowing bubbles, a screen 50 may be positioned over the outlet end 25 to create the desired fine flow pattern.

It is to be understood that while certain forms of the present invention have been illustrated and described herein, it is not to be limited to the specific forms or arrangement of parts described and shown.

What is claimed and desired to be secured by Letters Patent is as follows:

1. A liquid circulating apparatus comprising:

(a) an upright beam member having closed upper and lower ends forming an air chamber, means at said upper end for connection to a source of pressurized air, and said beam member being adapted for extending into a body of liquid;

(b) upper and lower support means for holding said beam member in said body;

(c) a bracket mounted on said beam member and means for moving said bracket up and down;

(d) a support arm affixed to and extending outwardly from said bracket and having an air passage therethrough with an inlet end toward said bracket and an outlet end displaced therefrom;

(e) a submersible motor mounted on said support arm and having a propulsion means operably connected to and rotatably powered by said motor to effect a flow of liquid in said body of liquid;

(f) said outlet end of said support arm being positioned generally at said propulsion means to inject a flow of air into said liquid; and (g) connection means extending between said inlet end and said beam member for flow of air through said beam member, said support arm and out said outlet end.

2. The apparatus set forth in claim 1 wherein:

(a) said connection means is selectively connectible and disconnectible.

3. The apparatus set forth in claim 2 wherein:

(a) said beam member has a stub arm protruding therefrom;

(b) said support arm and said stub arm have mating cones thereon with air passages extending through said cones for registration and passage of air when said cones interconnect.

4. The apparatus set forth in claim 1 wherein:

(a) said support arm is a narrow, rectangular beam;

(b) a shroud is mounted on said support arm adjacent said outlet end and encircles said propulsion means.

5. A liquid circulating apparatus comprising:

(a) an upright beam member for extending into a body of liquid, having closed upper and lower ends forming an air chamber, and with means at said upper end for connection to a source of pressurized air;

(b) upper and lower support means for holding said beam member in said body;

(c) a bracket mounted on said beam member and means moving said bracket up and down;

(d) a support arm affixed to and extending outwardly from said bracket and having an air passage therethrough with an inlet end toward said bracket and an outlet end spaced therefrom;

(e) a submersible motor mounted on said support arm and having a propeller operably connected to and rotatably powered by said motor to effect a flow of liquid in said body of liquid;

(f) said outlet end of said support arm being positioned generally at said propeller to inject a flow of air into said liquid;

(g) a stub arm protruding from said beam member and providing a stop to downward movement of said bracket and support arm;

(h) mating conical connectors extending between said stub arm and said support arm generally at said inlet end and having passages therethrough for routing pressurized air from said beam member, through said support arm and out said outlet end.

* * * * *